United States Patent [19]

Potter et al.

[11] Patent Number: 4,904,827

[45] Date of Patent: Feb. 27, 1990

[54] ELECTRIC CORD-PROTECTING SHIPPING PLUG

[75] Inventors: Elisha L. Potter; Harold J. Coleman, 403 Maple Ridge Dr.; Elisha L. Potter, 572 Northpark Ct., both of Bossier City, La. 71111

[73] Assignees: Harold Joseph Coleman; Elisha Lindsay Potter, both of Cleveland, Ohio

[21] Appl. No.: 303,811

[22] Filed: Jan. 30, 1989

[51] Int. Cl.[4] ..... B65D 59/00; H01B 17/58

[52] U.S. Cl. ..... 174/136; 16/2; 174/46; 174/83; 206/814

[58] Field of Search ..... 174/46, 83, 135, 136, 174/153 G, 155, 156, 167; 15/143 R, 143 A, 143 B, 144 R, 144 A, 144 B, 145, 410, DIG. 10; 16/2, 110 R; 56/DIG. 18; 206/320, 525, 527, 814

[56] References Cited

U.S. PATENT DOCUMENTS 3,643,290 2/1972 Milne ..... 16/2
3,879,573 4/1975 Ehrlich ..... 16/2 X
3,958,300 5/1976 Tanaka ..... 16/2
4,578,528 3/1986 Borsh et al. ..... 174/153 G X
4,752,652 6/1988 Danti et al. ..... 16/2 X

FOREIGN PATENT DOCUMENTS 2591680 6/1987 France ..... 403/291

*Primary Examiner*—Laramie E. Askin
*Attorney, Agent, or Firm*—Hubbard, Thurman, Turner, Tucker & Harris

[57] ABSTRACT

A plastic plug for protecting an electric cord from damage during shipping when such cord is shipped within separated rigid tubular components of a handle, or the like, comprises two semi-cylindrical half portions of a plug which are pivotally united along axially extending side edges of the half portions. With its half portions pivoted together, the plug defines a channel for leading the electric cord out of, or into either end of its associated rigid tubular component without contact between the cord and the adjacent end edge surface of the rigid tubular component.

8 Claims, 1 Drawing Sheet

ELECTRIC CORD-PROTECTING SHIPPING PLUG

BACKGROUND OF THE INVENTION

The present invention provides a shipping plug for protecting electric cords from damage when such cords are shipped in inserted relationship in a plurality of disassembled tubular metallic components, such as the axial handle portions of an electrically powered flexible line trimmer or the like.

Many electrically operated household, industrial and garden tools have their electric power supply cord mounted within an elongated tubular handle portion of the tool formed of metal or a rigid plastic. This provides substantial protection of the electric cord from damage during usage of the tool. Such tubular handles are, however, generally formed of tubular components telescopically assembled in end to end relationship and are generally shipped with the tubular components in disassembled form to minimize the bulk of the packaging. Since it is highly desirable that the connection of the electrical cord to the electric motor be effected at the factory, the cord is inserted through the disassembled components prior to shipment. This potentially subjects the cord to significant damage from the end edges of the separated rigid tubular components due to vibration of such components or the electric cord during the shipping process. The danger of substantial damage to the electric cord is particularly present when the handle components are formed of metal.

The prior art has not provided a shipping plug which may be assembled to, or disassembled from an electric cord and which, in its assembled position, surrounds the cord and essentially completely protects it from contact with the end edge portions of the rigid tubular elements within which the electrical cord is assembled. It is accordingly an object of the present invention to provide such a protective shipping plug.

SUMMARY OF THE INVENTION

The present invention uniquely provides a unitary injection molded plastic protective plug formed from two generally semi-cylindrical half portions which are integrally connected by an axially extending hinge section extending along facing side edges of the half portions. The semi-cylindrical half portions are foldable about the hinge section to form a generally cylindrical, tubular structure. Each half portion has at least one axially projecting prong for insertion within the end of a rigid tubular element when the plug is in its folded configuration, the prong having an enlarged end portion for frictionally engaging the bore of such rigid tubular element to secure the plug in its inserted position. Additionally, each half portion is provided with a radially projecting flange which is dimensioned to abut the end of the rigid tubular element into which the plug is inserted.

One of the semi-cylindrical half portions is provided with a single internally projecting radial tab which cooperates with a pair of similarly shaped, axially spaced, inwardly directed tab portions formed on the other half portion to axially interlock the two semi-cylindrical half portions when pivoted to their closed positions. In such closed position, radially inwardly projecting end tabs respectively provided on each semi-cylindrical half portion abut each other to define a top end wall of the plug.

Thus, when an electric cord is inserted in a rigid tubular handle component, the plastic plug element can be placed in surrounding relationship to the electric cord by pivoting the two semi-cylindrical half portions of the plug together to form a generally cylindrical, tubular plug configuration which plug is snugly insertable within the bore ends of the rigid tubular component. In such position, all portions of the electric cord entering or leaving the end of the rigid tubular handle component are completely surrounded by plastic components of the plug, thus assuring that no damage to the electric cord will be produced during shipment, even though such cord extends through a plurality of disassembled tubular components. The cord extends radially outwardly through an opening defined in the plug between its top end wall, which shields the cord from axial impact on the tubular element end, and the interlocked tab portions of the plug.

DETAILED DESCRIPTION

Figure 1:
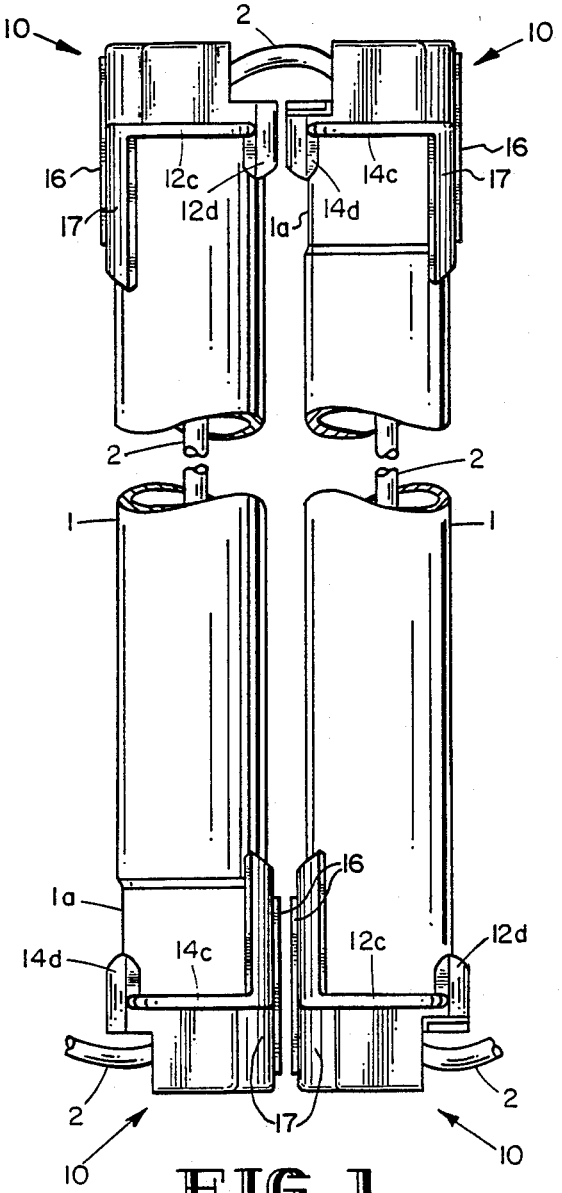
FIG. 1 is a schematic view illustrating the utilization of a plastic plug embodying this invention in protecting the entering and outgoing portions of an electrical cord lying in the bore of a disconnected tubular handle formed of two or more interconnectable rigid tubular elements.
Figure 2:
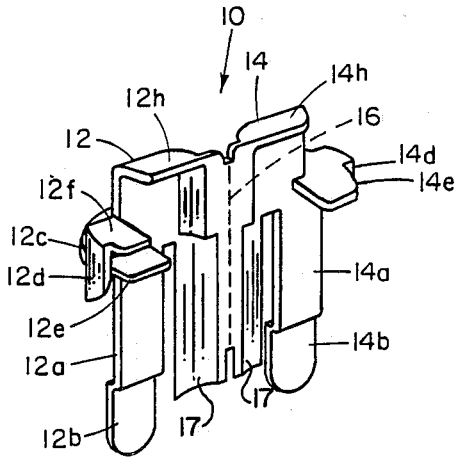
FIG. 2 is a perspective view of the plastic plug embodying this invention with the plug shown in its open position.

Referring to FIG. 1, there is shown a plurality of rigid tubular components 1 which can be telescopically assembled by a necked down end $\mathbf{1}_a$, in an end-to-end relationship, to form a handle for a tool, such as a flexible line trimmer or the like, having an electric motor (not shown). An electric cord 2 traverses the bore of the tubular components 1 when they are assembled in end to end relationship. However, for shipping purposes, it is desirable to disassemble the rigid tubular components and place them in an essentially side-by-side relationship in the shipping package. This necessarily means that portions of the electric cord which traverse the bore of components 1 must pass out of one end of one tubular component and into the end of an adjacent tubular component in the manner illustrated in FIG. 1. In accordance with the present invention, a uniquely configured protective plug 10, conveniently formed from an injection molded plastic material, is provided to protect the outgoing or incoming portions of the electric cord from damage by the handle portion end edges during shipment.

Referring now to FIGS. 2–5, the plastic plug 10 comprises two generally semi-cylindrical half portions 12 and 14 which are pivotally interconnected by integral hinge means 16 provided along the facing axial edges of elongated, laterally curved body sections 17 of the half portions. This permits the half portions to be folded from an open position (FIG. 2) to a closed position (FIG. 3) of generally cylindrical, tubular configuration surrounding the electric cord and providing protection therefor.

Figure 3:
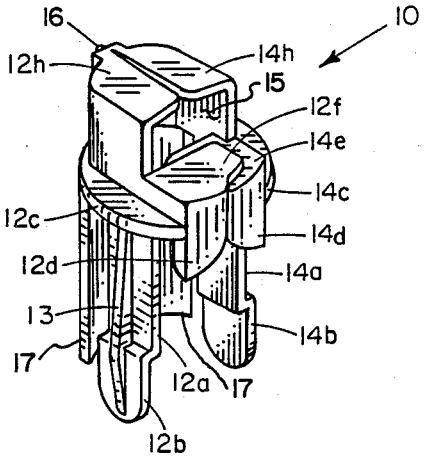
FIG. 3 is a perspective view of the plastic plug embodying this invention showing the plug in its closed position.

Each half portion 12 and 14 is provided with at least one axially extending prong, $12_a$ and $14_a$ respectively, which is dimensioned to fit within the bore of the rigid tubular component into which the plug 10 is to be inserted, and each prong has an enlarged head portion $12_b$ or $14_b$ for frictionally engaging the bore of such rigid tubular component. Each prong $12_a$ and $14_b$ may further be respectively provided with an axially extending stiffening rib 13 (FIG. 3).

Figure 5:
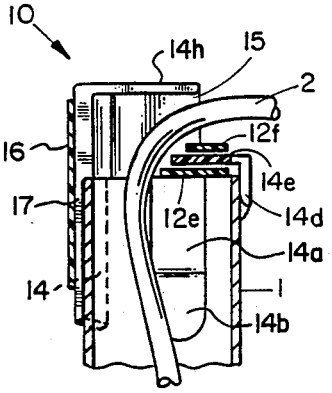
FIG. 5 is a cross-sectional view through the plug, taken long line 5—5 of FIG. 4, illustrating the plug protectively inserted within an end of a tubular component having an electrical cord extending therethrough.
Figure 4:
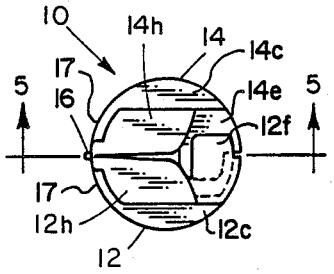
FIG. 4 is a top view of the plastic plug in its closed position.

Each half portion 12 and 14 is further provided with a radially projecting flange segment $12_c$ and $14_c$ which overlies the end face of the rigid tubular component 1 into which the plug is inserted and functions as a stop for the insertion movement of the plug 10. Additionally, axially dependent flanges $12_d$ and $14_d$ on the flange segments $12_c$ and $14_c$, as well as the plug body sections 17, snugly engage the exterior of the component 1, as illustrated in FIGS. 1 and 5, when the plug is operatively inserted into the end of its associated tubular element 1.

In addition, the generally semi-cylindrical half portion 12 is provided with a pair of axially spaced, internally projecting tabs $12_e$ and $12_f$ which extend substantially across one half of the bore of the plug 10 when folded to its cylindrical configuration. The other half portion 14 of the cylindrical plug 10 is provided with a single radially inwardly projecting tab portion $14_e$ which projects between the two axially spaced tab portions $12_e$ and $12_f$, thus assuring axial alignment of the half portions of the plug and providing a bottom surface against which the electric cord 2 may rest as it departs through a radial aperture 15 (FIGS. 3 and 5) defined by the plug 10 in its closed position.

To define such radial aperture, each half portion 12 and 14 of the plug 10 is further provided with inwardly projecting end tabs $12_h$ and $12_h$. These tabs are disposed in abutting relationship when the half portions 12 and 14 are folded to their closed positions (see FIGS. 3 and 4), thus defining an end wall for the plug and also defining the radial aperture 15 in cooperation with the uppermost tab $12_f$ formed on the half portion 12.

From the foregoing description, it will be apparent that the electric cord 2 is directed by the plug 10 in a substantially radial direction as it departs from, or enters the end of a rigid tubular element 1 through plug aperture 15. Moreover, all portions of the electric cord 2 which might otherwise contact the adjacent end edge of its associated tubular element 1 and be abraded or cut thereby are surrounded by plastic surfaces of the plug 10 so that the possibility of damage to the electric cord during shipment is substantially reduced. It can be seen that the plug end wall defined by the end tabs $12_h$ and $14_h$ protects the cord from axially directed impact received by the tube end in which the particular plug is operatively inserted. The fact that the electric cord 2 is disposed in such radial position permits the disassembled rigid tubular components 1 of the handle structure to be efficiently packed for shipment in side by side relationship.

The foregoing detailed description is to be clearly understood as being given by way of illustration and example only, the spirit and scope of the present invention being limited solely by the appended claims.

What is claimed is:

1. An article for protecting an electric cord from damage during shipment, said electric cord traversing the bores of a plurality of rigid tubular elements which are telescopically connectable in end to end relationship to form a unitary tubular structure but are disassembled for shipment, comprising:

a molded plastic structure comprising two generally semi-cylindrical half portions, each of said half portions defining a radially projecting flange abuttable with an end face of a tubular element in which said plastic structure is to be inserted to limit the depth of insertion;

integral hinge means interconnecting two axially extending edges of said semi-cylindrical half portions, whereby said half portions may be pivoted between a closed position encircling the electric cord and an open position permitting removal of said plastic structure from the electric cord, one of said semi-cylindrical half portions being provided with a single inwardly directed radial tab and said other semi-cylindrical half portion being provided with two axially spaced, inwardly directed tabs constructed and arranged to straddle said single tab when said half portions are pivoted to said closed position, a radially inwardly projecting end tab being formed on each of said semi-cylindrical half portions, said end tabs being abuttable in said closed position of said plastic structure to form an end wall;

said plastic structure being snugly insertable in either end of said rigid tubular elements in said closed position of said plastic structure;

said plastic structure further defining in said closed position an opening surrounded entirely by plastic material for passage of the electric cord away from the end of the respective rigid tubular element, said opening extending generally radially and being located above one of said radially projecting flanges, whereby the electric cord leaves or enters each said plastic structure in a generally radial direction relative thereto, said radial opening being defined between the uppermost one of said axially spaced tabs and said end wall.

2. An article for protecting an electric cord from damage during shipment, said electric cord traversing the bores of a plurality of rigid tubular elements which are telescopically connectable in end to end relationship to form a unitary tubular structure but are disassembled for shipment, comprising:

a molded plastic structure comprising two generally semi-cylindrical half portions;

integral hinge means interconnecting two axially extending edges of said semi-cylindrical half portions, whereby said half portions may be pivoted between a closed position encircling the electric cord and an open position permitting removal of said plastic structure from the electric cord, one of said semi-cylindrical half portions being provided with a single inwardly directed radial tab and the other semi-cylindrical half portion being provided with two axially spaced, inwardly directed tabs constructed and arranged to straddle said single tab when said half portions are pivoted to said closed position, each said half portion including at least one axially extending, integral prong at a location angularly displaced from said integral hinge means, each prong having a radially outwardly displaced end portion for frictionally engaging the bore wall of the largest diameter end of one of the rigid tubular elements;

said plastic structure being snugly insertable in either end of said rigid tubular elements in said closed position of said plastic structure; and said plastic structure further defining in said closed position an opening surrounded entirely by plastic material for passage of the electric cord away from the end of the respective rigid tubular element.

3. An article for protecting an electric cord from damage during shipment, said electric cord traversing the bores of a plurality of rigid tubular elements which are telescopically connectable in end to end relationship to form a unitary tubular structure but are disassembled for shipment, comprising:

a molded plastic structure comprising two generally semi-cylindrical half portions, each of said half portions defining a radially projecting flange abuttable with an end face of a tubular element in which said platic structure is to be inserted to limit the depth of insertion;

integral hinge means interconnecting two axially extending edges of said semi-cylindrical half portions, whereby said half portions may be pivoted between a closed position encircling the electric cord and an open position permitting removal of said plastic structure from the electric cord, one of said semi-cylindrical half portions being provided with a single inwardly directed radial tab and the other semi-cylindrical half portion being provided with two axially spaced, inwardly directed tabs constructed and arranged to straddle said single tab when said half portions are pivoted to said closed position;

said plastic structure being snugly insertable in either end of said rigid tubular elements in said closed position of said plastic structure;

said plastic structure further defining in said closed position an opening surrounded entirely by plastic material for passage of the electric cord away from the end of the respective rigid tubular element, said opening extending generally radially and being located above one of said radially projecting flanges, whereby the electric cord leaves or enters each said plastic structure in a generally radial direction relative thereto.

4. An article for protecting an electric cord from damage during shipment, said electric cord traversing the bores of a plurality of rigid tubular elements which are telescopically connectable in end to end relationship to form a unitary tubular structure but are disassembled for shipment, comprising:

a molded plastic structure comprising two generally semi-cylindrical half portions;

integral hinge means interconnecting two axially extending edges of said semi-cylindrical half portions, whereby said half portions may be pivoted between a closed position encircling the electric cord and an open position permitting removal of said plastic structure from the electric cord;

said plastic structure being snugly insertable in either end of said rigid tubular elements in said closed position of said plastic structure;

said plastic structure further defining in said closed position an opening surrounded entirely by plastic material for passage of the electric cord away from the end of the respective rigid tubular element; and an axially projecting flange on each said semi-cylindrical half portion constructed and arranged to snugly engage the exterior surface of the rigid tubular element into which said plastic structure is to be inserted.

5. An article for protecting an electric cord from damaging during shipment, said electric cord traversing the bores of a pluarlity of rigid tubular elements which are telescopically connectable in end to end relationship to form a unitary tubular structure but are disassembled for shipment, comprising:

a molded plastic structure comprising two generally semi-cylindrical half portions;

integral hinge means interconnecting two axially extending edges of said semi-cylindrical half portions, whereby said half portions may be pivoted between a closed position encircling the electric cord and an open position permitting removal of said plastic structure from the electric cord, each said half portion including at least one axially extending, integral prong at a location angularly displaced from said integral hinge means, each prong having a radially outwardly displaced end portion for frictionally engaging the bore wall of the largest diameter end of one of the rigid tubular elements;

said plastic structure being snugly insertable in either end of said rigid tubular elements in said closed position of said plastic structure;

said plastic structure further defining in said closed position an opening surrounded entirely by plastic material for passage of the electric cord away from the end of the respective rigid tubular element; and an axially projecting flange on each said semi-cylindrical half portion constructed and arranged to snugly engage the exterior surface of the rigid tubular element into which said plastic structure is to be inserted.

6. An article for protecting an electric cord from damage during shipment, said electric cord traversing the bores of a plurality of rigid tubular elements which are telescopically connectable in end to end relationship to form a unitary tubular structure but are disassembled for shipment, comprising:

a molded plastic structure comprising two generally semi-cylindrical half portions, each of said half portions defining a radially projecting flange abuttable with an end face of a tubular element in which said plastic structure is to be inserted to limit the depth of insertion;

integral hinge means interconnecting two axially extending edges of said semi-cylindrical half portions, whereby said half portions may be pivoted between a closed position encircling the electric cord and an open position permitting removal of said platic structure from the electric cord;

said plastic structure being snugly insertable in either end of said rigid tubular elements in said closed position of said plastic structure;

said plastic structure further defining in said closed position an opening surrounded entirely by plastic material for passage of the electric cord away from the end of the respective rigid tubular element; and an axially projecting flange on each said semi-cylindrical half portion constructed and arranged to snugly engage the exterior surface of the rigid tubular element into which said plastic structure is to be inserted.

7. An article for protecting an electric cord from damage during shipment, said electric cord traversing the bores of a plurality of rigid tubular elements which are telescopically connectable in end to end relationship to form a unitary tubular structure but are disassembled for shipment, comprising:

a molded plastic structure comprising two generally semi-cylindrical half portions, each of said half portions defining a radially projecting flange abuttable with an end face of a tubular element in which said plastic structure is to be inserted to limit the depth of insertion;

integral hinge means interconnecting two axially extending edges of said semi-cylindrical half portions, whereby said half portions may be pivoted between a closed position encircling the electric cord and an open position permitting removal of said plastic structure from the electric cord;

said plastic structure being snugly insertable in either end of said rigid tubular elements in said closed position of said plastic structure;

said plastic structure further defining in said closed position an opening surrounded entirely by plastic material for passage of the electric cord away from the end of the respective rigid tubular element, said opening extending generally radially and being located above one of said radially projecting flanges, whereby the electric cord leaves or enters each said plastic structure in a generally radial direction relative thereto; and an axially projecting flange on each said semi-cylindrical half portion constructed and arranged to snugly engage the exterior surface of the rigid tubular element into which said plastic structure is to be inserted.

8. For use in protecting an electric cord from contact with and damage from an outer end edge of a tubular member through which the cord axially extends, the cord extending generally radially outwardly across the outer end edge, a protective shipping plug removably connectable around the cord and to the tubular member on the end thereof containing the outer end edge, said protective shipping plug comprising:

a hollow body formed from a cord-protective material and circumscribing and extending along a central axis, said body being defined by first and second lateral halves hingedly interconnected along a hinge axis laterally offset from and generally parallel to said central axis for pivotal movement between an open position and a closed position; and cooperating means on said first and second lateral halves for defining on said body in said closed position thereof:

an outer end closure wall, a generally radially extending cord opening in a side wall portion of said body positioned axially inwardly of said outer end closure wall, said opening being bounded at an axially outer end thereof by said outer end closure wall and entirely circumscribed by the cord-protective material of said body, and means, positioned axially inwardly of said opening, for coaxially and releasably connecting said body to the tubular member with said opening positioned axially outwardly of the outer end edge of the tubular member, and with the cord extending axially through said body and generally radially outwardly through said opening therein, said lateral halves of said body being constructed and arranged to sequentially permit said body to be operatively closed around a portion of the cord external to the tubular member, slid inwardly along the cord toward the outer end edge of the tubular member, and then be operatively secured to the tubular member.

* * * * *